US005437743A

United States Patent [19]

Culling

[11] Patent Number: 5,437,743

[45] Date of Patent: Aug. 1, 1995

[54] WELDABLE HEAT RESISTANT ALLOY

[75] Inventor: John H. Culling, St. Louis, Mo.

[73] Assignee: Carondelet Foundry Company, Peveley, Mo.

[21] Appl. No.: 277,177

[22] Filed: Jul. 19, 1994

[51] Int. Cl.[6] ..... C22C 30/00

[52] U.S. Cl. ..... 148/419; 420/584.1

[58] Field of Search ..... 420/584.1, 585, 586; 148/419, 442

[56] References Cited

U.S. PATENT DOCUMENTS

| | | | |
|---|---|---|---|
| 2,540,107 | 2/1951 | English et al. | 75/171 |
| 3,127,265 | 3/1964 | Avery | 75/171 |
| 3,607,250 | 9/1971 | English et al. | 75/171 |
| 4,842,823 | 6/1989 | Sawaragi et al. | 420/586 |

FOREIGN PATENT DOCUMENTS

| | | | |
|---|---|---|---|
| 508889 | 1/1955 | Canada | 420/586 |
| 56-81661 | 7/1981 | Japan | 420/584.1 |
| 1046603 | 7/1965 | United Kingdom . | |

OTHER PUBLICATIONS

Matsuo et al., "Strengthening Mechanisms of Ni-Cr-W Based Superalloys for Very High Temperature Gas Cooled Reactors", Heat-Resistant Materials, Proceedings of the First International Conference, Fontana, Wisconsin, Sep. 23-26, 1991, pp. 601-614.

*Primary Examiner*—Deborah Yee
*Attorney, Agent, or Firm*—Senniger, Powers, Leavitt & Roedel

[57] ABSTRACT

Moderate cost air meltable, highly weldable nickel-chromium-iron alloys of high hot strength and excellent hot gas corrosion resistance especially in the service temperature range of 1600° F. to 2200° F. Which may be formulated to provide for good weldability before and after high temperature aging consisting essentially of:

| | |
|---|---|
| Nickel | 33-40% by weight |
| Chromium | 24-30% |
| Iron | 14-32% |
| Tungsten | 8-17% |
| Carbon | Up to 0.12% |
| Manganese | Up to 1% |
| Silicon | Up to 1.2% |
| Chromium plus tungsten | 34-44% |

15 Claims, No Drawings

WELDABLE HEAT RESISTANT ALLOY

BACKGROUND OF THE INVENTION

There is a great demand for large cast shapes and large cast weld structures in petrochemical, heat treating, and other fields. The desired metallic properties are long life, high hot strength, good resistance to thermal fatigue and thermal shock and good weldability at moderate cost.

The nickel-base superalloys developed primarily for aircraft jet engine components since World War II achieve hot strength through solid solution hardening by inclusion in the alloys of large quantities of molybdenum and, to a lesser extent, niobium (columbium), plus precipitation at or along the grain boundaries of very fine particles of gamma prime, a compound formed between nickel and fairly large amounts of aluminum plus titanium. Since aluminum and titanium are readily oxidized in air melting practices, these nickel-base superalloys are melted and poured in a vacuum or an inert atmosphere. This requirement plus the high cost of such alloys make them impractical for the present application.

Cobalt-base superalloys were also developed for aircraft jet engine components. These alloys derive their hot strength primarily by solid solution hardening by elements of the group Mo, W, Nb, and Ta, plus precipitation of refractory carbides along the metallic grain boundaries. A few cobalt-base alloys and cobalt-nickel base alloys have also employed gamma prime hardening. Cobalt remains a relatively scarce and expensive metal, and therefore cobalt-base superalloys are far too expensive for the large structures discussed here.

Both cast and wrought iron-nickel-chromium-base alloys have been the economical choice in these applications. Wrought alloys of less than about 0.15% C content, sometimes containing about 1.5% or less combined content of aluminum plus titanium, have been employed as headers, manifolds, cones, and transfer lines. These alloys have excellent weldability and good resistance to thermal cracking in service. They have relatively very low hot strengths.

However, the higher hot strength, higher carbon casting alloys permit reduction in wall thickness, reduction of metal weight and better rate of heat transfer. Nickel-iron-chromium-base alloys have been modified to include up to about 1% Nb, up to about 5% W and up to about 15% Co for increased hot strength. In general those cast alloys of about 0.45 to 0.55% C contents have higher hot strengths but very poor to almost no weldability, while cast alloys of about 0.35 to 0.40% C contents have substantially lower hot strengths but some degree of weldability.

These carbon strengthened alloys tend to age and embrittle in service. Thus, they may easily crack during thermal cycling. Alloys that, on a creep-rupture test basis, should last about ten years have sometimes been found to fail in cracking after perhaps one year or so in service. Also, in some applications it is desirable to weld repair some components after periods of service.

Alloys which include substantial amounts of iron in their formulation are, in general, considerably less expensive than nickel-base, iron-free alloys for at least two reasons. They may employ much lower cost ferroalloys to make up their contents of chromium, and sometimes other components, as contrasted to the higher cost pure chromium and other metals required in nickel-base alloys, In addition, the mere replacement of even a portion of the moderately expensive nickel by very low cost iron represents substantial component cost savings. In alloys of the present invention a third extremely important advantage of including substantial quantities of iron in their formulation is that they develop higher hot strengths than the far costlier iron free nickel base alloys of the equivalent hardness and weldability and of the same tungsten contents.

Thus, there has remained a great demand in oil refineries, petrochemical plants, heat treating equipment, and other applications or moderate cost, for air meltable nickel-iron-chromium-base alloys that do not require large amounts of carbon in their formulation for hot strength and that have exceptional weldability as cast. It is further desirable in some instances that such alloys retain good room temperature ductility and weldability after periods of service at high temperature.

English, et al, U.S. Pat. No. 2,540,107, disclosed a modification of alloy type HP containing 40 to 60% Ni, 22 to 34% Cr and 4 to 6.5% W and known commercially as alloy 22H. English, U.S. Pat. No. 3,607,250, disclosed an improved version known as super 22H, containing 40 to 55% Ni, 27 to 33% Cr, 4 to 5% W and 2 to 4.5% Co. Avery, U.S. Pat. No. 3,127,265, disclosed an alloy know as Supertherm, which contains 26 to 42% Ni, 22 to 32% Cr, 3 to 16% W, 9 to 26% Co, 0.3 to 0.95% C, 0.5 to 2% Si, and the balance, if any, iron. In practice, this alloy nominally contains about 35% Ni, 26% Cr, 15% Co, 5% W, 0.5% C, 0.7% Mn, 1.6% Si and 21% Fe. British Pat. No. 1,046,603 disclosed a nickel base alloy known as MO-RE 2, containing 26 to 38% Cr, 10 to 25% W, less than 1% C, less than 0.2% each of Mn and Si, and the balance Ni. All four of these alloys are characterized by low cold ductility and little if any weldability.

Nickel base superalloys, other than MO-RE 2, and cobalt base superalloys have employed up to 15% W, up to 14.5% Mo, up to 5.6% Nb and up to 9% Ta in order to attain high substitutional solid solution matrix hardening and strengthening, and in many cases, to additionally form hard refractory carbides. There is some information in the literature concerning the solid solubility limits of these four elements at various elevated temperatures and as affected by different levels of chromium in nickel base alloys, but there is almost nothing reported concerning how much these solubility limits are affected by various levels of carbon and iron additions to complex alloys which otherwise contain various levels of nickel, chromium, manganese, silicon, aluminum, titanium and possibly cobalt.

SUMMARY OF THE INVENTION

It is therefore an object of this invention to provide moderate cost air meltable, highly weldable nickel-chromium-iron alloys of high hot strength and excellent hot gas corrosion resistance especially in the service temperature range of 1600° F. to 2200° F.

According to this invention alloys are provided which consist essentially of:

| | |
|---|---|
| Nickel | 33–40% by weight |
| Chromium | 24–30% |
| Iron | 14–32% |
| Tungsten | 8–17% |
| Carbon | Up to 0.12% |
| Manganese | Up to 1% |
| Silicon | Up to 1.2% |

-continued

| | |
|---|---|
| Chromium plus Tungsten | 34–44% |

Optionally, the alloys of the invention may further contain:

| | |
|---|---|
| Titanium | Up to 0.8% |
| Aluminum | Up to 0.8% |
| Zirconium | Up to 0.15% |
| Boron | Up to 0.01% |
| Cobalt | Up to 0.8% |

DETAILED DESCRIPTION OF THE INVENTION

In accordance with the present invention alloys are provided which have high hot strength and excellent hot gas corrosion resistance to 2200° F. combined with excellent weldability. They are air meltable and castable and of moderate cost.

In addition to having outstanding weldability and high temperature hot strengths there are other advantages to the instant alloys due to the fact that they contain substantial amounts of iron and little or no carbon. Prior art nickel base and cobalt base superalloys are far too costly to be employable in large cast weld structures for which the alloys of the present invention are directed. Alloys of the present invention may employ the much less costly ferrochromium for their chromium contents instead of the much costlier electrolytic or other pure chromium sources. Additionally the much lower melting ferrotungsten may be employed in place of the very high melting point pure tungsten that is often only partially dissolved in production of iron-free or very low iron content alloys.

The relatively high carbon contents of prior art nickel-iron-chromium-base alloys result, not only in rather high room temperature hardness regardless of thermal history, but also in a pronounced tendency to develop hot tears or thermal shock cracks during the casting and cleaning process itself and in service which involves thermal cycling.

To the contrary, the very low carbon alloys of the present invention are characterized by surprisingly low hardness and high tensile elongations at all temperatures during the casting, cleaning, grinding, and welding processes, but their hardnesses and hot strengths can then be increased by a mere short term heat treatment or during the first day of exposure to service temperatures to a degree unheard of in carbide strengthened alloys.

The Alloy Casting Institute Division of the Steel Founder's Society of America type HP alloy was selected as a nominal starting base composition in the development of the alloys of the present invention, because it is metallurgically stable even when its carbon content is reduced or removed and because it has the highest hot strength of any standard alloys of the series at temperatures above about 1600° F.

Alloy type HP is also the basic alloy that led to the best of the other prior art nickel-iron-chromium-base heat resistant alloys that have been employed in larger cast-weld structures. Alloy type HP contains nominally about 35% Ni, 25% Cr, 0.35 to 0.75% C, up to 2% each of Mn and Si and the balance essentially iron.

The iron levels of the alloys of the invention were deliberately kept high, not only to reduce nickel content and to permit formulation with low cost ferroalloys, but also in order to reduce the solid solubility of chromium and tungsten in the matrix. It was found that tungsten additions of up to approximately the solid solubility limit in Ni-Fe-Cr-base alloys increased their high temperature rupture lives, typically by a factor of about ten, and that further increases of tungsten far beyond the solubility limit for a given Ni-Fe-Cr-W alloy composition typically further almost tripled the rupture life, that is, an increase of thirty folds. These rupture lives were even further increased by additions of certain minor elements. Thus the presence of substantial levels of iron in the alloys of the invention substantially reduced the tungsten levels required in the iron-free alloys to attain these various increases in high temperature service live. Iron levels between about 14% and 32% were found to be most desirable. Nickel contents of the alloys of the invention must be high enough to maintain an austenitic or face-center-cubic matrix crystal structure. Since iron, chromium and tungsten all tend to form the opposite undesirable body-center-cubic crystal lattice structure, a nickel range of about 33 to 40% was found to be required in alloys of the invention. While slightly lower chromium levels will suffice to achieve adequate oxidation or other hot gas corrosion resistance up to about 2200° F. in alloys of higher nickel contents, chromium contents between about 24% and 29% are required for the nickel levels of the alloys of the invention. Greater than about 30% Cr content results in metallurgicallyunstable alloys at these nickel and tungsten levels. Some nickel ore deposits also contain small quantities of the sister element cobalt. Also, cobalt is present in some high nickel alloy scraps. It has been found that at least about 0.8% Co may be included in alloys of the present invention without detriment.

Molybdenum in nickel base alloys is known to form carbides when carbon is present and to form an intermetallic compound of $Ni_7Mo_6$, when little or no carbon is present. Molybdenum is also notorious for forming the hard, brittle destructive electron compound known as sigma phase when present in many high temperature alloys formulated to contain various quantities of nickel, cobalt, chromium, iron and other elements. Thus, large amounts of molybdenum remove nickel from the matrix as well as cause other undesirable metallurgical effects. It has been found that up to about 0.8% Mo may be tolerated in alloys of the invention without serious detriment. In a similar manner large amounts of niobium will form carbides with any carbon present in nickel base alloys as well as the intermetallic $Ni_3Nb$ compound in low carbon alloys. Niobium is also known to promote the brittle sigma phase in many alloys. It is also a very expensive element. Therefore, niobium was not deliberately incorporated in alloys of the present invention. However, it has been determined that as much as about 0.3% Nb may be present in alloys of the invention without serous detriment.

Tantalum is actually a scarce and very expensive element and thus not considered as practical addition to the alloys of the present invention. Thus tungsten remained the element of choice for both solid solution hardening and precipitation hardening of alloys of the invention. To achieve these ends, tungsten levels between about 8% and about 17% were found to best attain the desired hot strengths, rupture lives, and other alloy properties.

Carbon has been employed in heat resistant alloys to form large amounts of carbides precipitated at the grain boundaries. Its effect as an interstitial solid solution strengthener is ordinarily either ignored or unknown. Carbon is present in alloys of the invention at levels below about 0.12%, and preferably in the range of about 0.04% to 0.08%. At these low carbon levels only very minor amounts of carbides are observed under the microscope in highly polished samples of alloys of the invention, yet the increase in rupture lives of these alloys is substantially higher than those attained when carbon levels are below about 0.02%. Small amounts of carbon probably not only increase interstitial solid solution strengthening, but also appear to somewhat lower the substitutional solid solution level of tungsten for any specific iron, nickel, and chromium levels. Increased quantities of precipitated tungsten particles appear to result from the presence of very small amounts of carbon. Higher than about 0.08 to 0.12% carbon not only produces large amounts of undesirable grain boundary carbides but also combines with tungsten to lower its effectiveness as a hot strengthener as described above.

Titanium, manganese and silicon also appear to lower the matrix solubility for tungsten at a given chromium level without forming undesirable tungsten compounds. However, a silicon content greater than about 1.2% in higher tungsten alloys of the invention and greater than about 0.9% in lower tungsten alloys of the invention seem to reduce high temperature rupture life. The same is found to be the case with greater than about 1% Mn at any tungsten level. Thus, silicon should be held below about 1.2%, and preferably below about 0.9%, in alloys of the invention, while manganese should also be held below about 0.8%. Small amounts of titanium appear to increase the amount of precipitated tungsten, but greater than about 0.8% Ti caused much of this precipitate to form within the grains rather than at the grain boundaries. Therefore titanium should be held below about 0.8%. Up to about 0.005% B and/or about 0/06% Zr were also found to enhance rupture life, but greater than about 0.01% B or about 0.15% Zr lower cold ductility and weldability of the alloys of the invention.

While precise levels of large amounts of both aluminum and titanium are virtually impossible to control in air melting practices due to their pronounced tendencies to oxidize at the molten alloy temperatures, smaller amounts of these two elements may be employed effectively. For example, if about 1% Ti is added to an alloy of the invention in the molten state and only a half or a quarter of this addition remains unoxidized and in metallic solution, the beneficial effects of the addition appear to be about the same for both recovery levels. Thus, it is desirable to have from about 0.25% to 0.70% Ti in the present alloys. In a similar fashion, aluminum may be employed as a deoxidizer in alloys of the invention in which both silicon and manganese are held to very low levels. In these instances the residual amount of recovered metallic aluminum is relatively unimportant, since the metallic bath has been reduced to a very low oxygen level by that part of the aluminum addition that was oxidized and collected in the slag. However, in very low silicon and manganese alloys of the invention, it is preferable to deoxidized with aluminum prior to the titanium addition so that some residual metallic titanium is held in the final alloy solution.

It has been well known for many decades that alloys based upon some combination of nickel, iron, cobalt, and chromium require, for long service life at high stress and at high temperature, a stable austenitic or gamma face-centered-cubic crystal matrix structure and that alloys which form the brittle sigma phase will be short lived and prone to crack in service. Nickel, cobalt, carbon and nitrogen favor the formation of an austenitic structure. The metallurgical literature of several decades has taught that large combined quantities of elements from the group chromium, molybdenum, tungsten, niobium, tantalum, vanadium, titanium, zirconium, silicon, and aluminum in solid solution favor the formation of ferritic or alpha body-centered-cubic matrix crystal structure. All of the elements of the second group except silicon and aluminum also form carbides when carbon is present in these alloys. Some, if not all, of those same elements tend to form nitrides when nitrogen is present. As noted above, titanium, aluminum, molybdenum, and niobium may also combine with nickel to form metallic compounds that precipitate from the solid solution and therefore no longer enter into matrix reactions. The literature of the last several decades has also taught that these ferrite formers promote formation of sigma phase at elevated temperatures especially between about 1500° and 1700° F. Therefore, in the low carbon alloys of the present invention large enough quantities of tungsten to form tungsten precipitates would surely be expected to form sigma phase when present with such high levels of chromium and iron, if the literature teaching of these decades were correct. Surprisingly, sigma phase was not detected in alloys of the invention that were exposed to temperatures that favor the formation of sigma phase.

As noted above, the presence of tungsten in solid solution within the matrices of alloys of the invention increases hot strength and high temperature rupture life to some extent. Much greater increases in hot strength and rupture life are achieved at higher alloy tungsten levels when fine particles of tungsten precipitates are formed at the alloy grain boundaries. Further increases in tungsten content eventually result in coarse or excessive amounts of tungsten precipitates that then result in reductions of hot strength and rupture life. The quantities of tungsten that may be retained in solid solution in alloys of the invention are to some extent determined by levels of nickel as well as levels of minor elements discussed above, but to a major extent by the quantity of chromium present. I have discovered that the maximum hot strengths in alloys of the invention are achieved when the combined quantities of chromium plus tungsten are between about 38.5% and 43% by weight. When chromium plus tungsten weight per cent contents exceed this range, rupture lives at any temperature and stress level decline very rapidly. At any given stress and temperature a combined content of about 41% Cr plus W appears to result in maximum rupture life of alloys of the invention. Since it has been found that 24% to 30% Cr is required in alloys of the invention for adequate hot gas corrosion to about 2200° F., it would be desirable to formulate such alloys to contain about 17% W at 24% Cr level down to about 11% W at 30% Cr level. It is desirable to select somewhat lower tungsten levels if elements of the group carbon, manganese, silicon, boron, titanium, zirconium, and aluminum are present in combinations and levels toward the high end of their ranges.

For maximum hot strength in applications involving minimal thermal cycling or rate of temperature change and requiring welding only prior to service exposure, the following ranges of component elements have been found to be preferable.

| | |
|---|---|
| Nickel | 35–40% by weight |
| Chromium | 24–29% |
| Iron | 14–25% |
| Tungsten | 8.5–17% |
| Carbon | Up to 0.10% |
| Manganese | 0.3–0.8% |
| Silicon | 0.3–0.6% |
| Titanium | Up to 0.7% |
| Aluminum | Up to 0.3% |
| Zirconium | 0.03–0.06% |
| Boron | Up to 0.005% |
| Cobalt | Up to 0.8% |
| Chromium plus Tungsten | 38.5-43% |

For excellent weldability both prior to and after high temperature service exposure that may involve frequent an/or rapid thermal cycling but of lower hot strength, the following ranges of component elements have been found to be preferred:

| | |
|---|---|
| Nickel | 33–40% by weight |
| Chromium | 24–29% |
| Iron | 18–31% |
| Tungsten | 8–13% |
| Carbon | 0.04–0.08% |
| Manganese | 0.2–0.6% |
| Silicon | 0.1–0.6% |
| Titanium | 0.3–0.7% |
| Aluminum | Up to 0.3% |
| Zirconium | Up to 0.06% |
| Boron | Up to 0.005% |
| Cobalt | Up to 0.80% |
| Chromium plus Tungsten | 34–38% |

The following examples further illustrate the invention.

Example 1

Three one hundred pound heats of three alloys were prepared in accordance with the invention by air melting in a high frequency induction furnace and casting into appropriate shapes for tensile test bars. The analyses of these heats are indicted in Table I as 10.3 W,13.1 W and 15.1 W. In a similar manner a 500 pound heat was prepared and cast into similar shapes for test bars as well as into welding test plates measuring approximately 6" by 12" by 1" thickness, with on edge suitably bevelled for multipass welding. The analysis of this heat is set forth in Table I as 12 W. In a similar manner a 500 pound heat was prepared a portion of which was cast into tensile bar and weld plate castings with the analysis indicated in Table 1 as 14.6 W. A quantity of pure nickel was then added to the molten remainder of the 500 pound heat left in the furnace altering it chemically to raise the nickel content but to dilute the contents of other elements. This altered metal was also cast into tensile and weld plate castings. The analysis of this altered composition is set forth in Table I as 13.6 W.

Hardnesses and tensile tests were conducted on as cast bars from each heat. Other bars from each heat were held at 1650° F. for 24 hours, slowly cooled in the oven and then tested for hardness and tensile properties The results of these tests are set forth in Table I.

From decades of experience with experimental and production heats of hundreds of different heat resistant alloy types, I have learned that those above about 7 or 8% room temperature elongations have good weldability. Weld plates of alloys 12 W, 13.6 W and 14.6 W as cast and of 12W in the aged condition were welded together by SUPER22H welding electrodes. These electrodes nominally contain about 48% Ni, 28% Cr, 5% W, small amounts of C, Mn, and Si and the balance essentially Fe.

All of the weldments were examined by x-ray and 10× magnification, and no cracks or defects were observed in any of them.

TABLE I

| | ALLOY DESIGNATION | | | | | |
|---|---|---|---|---|---|---|
| | 10.3 W | 12 W | 13.1 W | 13.6 W | 14.6 W | 15.1 W |
| CHEMICAL COMPOSITION BY WEIGHT | | | | | | |
| Ni | 36.65 | 39.08 | 37.27 | 37.13 | 34.18 | 39.13 |
| Cr | 28.12 | 25.51 | 27.92 | 28.18 | 29.41 | 27.54 |
| Fe | 22.60 | 22.01 | 20.05 | 18.95 | 19.39 | 16.76 |
| W | 10.33 | 11.92 | 13.11 | 13.62 | 14.63 | 15.12 |
| Co | 0.11 | 0.08 | 0.22 | 0.03 | 0.03 | 0.16 |
| Mo | 0.19 | 0.12 | 0.12 | 0.14 | 0.18 | 0.09 |
| Mn | 0.76 | 0.52 | 0.41 | 0.74 | 0.75 | 0.33 |
| Si | 0.82 | 0.61 | 0.48 | 0.89 | 1.09 | 0.41 |
| C | 0.055 | 0.023 | 0.065 | 0.050 | 0.044 | 0.060 |
| Ti | 0.26 | 0.05 | 0.27 | 0.22 | 0.25 | .36 |
| B | 0.005 | 0.003 | 0.005 | Nil | Nil | .005 |
| Nb | 0.05 | 0.03 | 0.04 | 0.05 | 0.05 | Nil |
| Zr | 0.05 | 0.04 | 0.04 | Nil | Nil | .03 |
| Cr + W | 38.45 | 37.43 | 41.03 | 41.80 | 44.04 | 42.66 |
| As Cast Properties: | | | | | | |
| Tensile Strength, PSI | 73,500 | 72,000 | 73,000 | 74,000 | 69,300 | 72,000 |
| Yield Strength, PSI | 32,000 | 30,000 | 38,000 | 39,600 | 45,300 | 40,100 |
| % Elongation | 45 | 48 | 35 | 27 | 16 | 24 |
| Brinell Hardness | 108 | 116 | 136 | 143 | 156 | 150 |
| Properties Aged 24 Hrs at 1650° F.: | | | | | | |
| Tensile Strength, PSI | 91,000 | 100,000 | 90,000 | 91,100 | 82,700 | 90,000 |
| Yield Strength, PSI | 55,000 | 52,000 | 60,500 | 63,000 | 63,000 | 62,000 |
| % Elongation | 13 | 8 | 4 | 3 | 2 | 3 |
| Brinell Hardness | 238 | 217 | 268 | 286 | 302 | 295 |

Example 2

Aged samples from alloys 12 W, 13.6 W, and 14.6 W were polished, etched, and examined at various magnifications under the microscope.

A few polygonal crystals of titanium carbonitride were observed within the grain boundaries here and there in 13.6 W and 14.6 W samples but none were seen in the 12 W sample. Also, very small amounts of carbides were observed at grain boundaries of 13.6 W and 14.6 W but not those of 12 W.

This suggests that all or almost all of the carbon content of 12 W remains in solid solution even after aging at 1650° F.

Another apparent phase was observed surrounding austenitic grains of 12 W and in larger quantities around grains of the 13.6 W sample and in far larger quantities in the 14.6 W samples. This phase is apparently related to the quantity of tungsten present in these low carbon alloys. The samples were etched to detect sigma phase, but none was apparent. All three aged samples registered less than 1.01 magnetic permeability on a high sensitivity low MU permeability indicator. Since ferrite is strongly ferromagnetic the above observed phase cannot be ferrite. As noted above, this is contrary to the literature teachings of the past several decades.

While alloy 12 W retained good weldability after aging, its hardness levels before and after aging are consistent with relatively low amounts of tungsten precipitates. The lower nickel content and higher carbon, titanium, silicon, and boron levels combined with the higher combined chromium plus tungsten level of 10.3 W would be expected to form greater quantities of tungsten precipitates in 10.3 W than those of 12 W. As will be seen below, 10.3 W has much higher rupture life values than 12 W despite the lower tungsten content of the former.

In a contrary manner, the lower chromium plus tungsten content of 15.1 W will be shown below to result in much higher rupture life than 14.6 W despite the higher tungsten content of the former.

EXAMPLE III

Standard 5/16 inch diameter creep-rupture bars were machined from cast materials of each inventive alloy of Table 1 and tested at various temperatures and stress levels on cantilever creep-rupture testing machines. The results of these tests are set forth in Table II below.

TABLE II

RUPTURE LIVES OF ALLOYS OF THE INVENTION AT VARIOUS TEMPERATURES AND STRESSES

| | 10.3 W | 12 W | 13.1 W | 13.6 W | 14.6 W | 15.1 W |
|---|---|---|---|---|---|---|
| 1600° F. | | | | | | |
| 10,000 PSI | — | — | 1279 | — | — | — |
| 9,000 PSI | 692 | — | — | — | — | 1209 |
| 8,000 PSI | — | — | — | 1023 | — | — |
| 7,000 PSI | — | 283 | — | — | 442 | — |
| 1700° F. | | | | | | |
| 7,000 PSI | — | — | 1199 | — | — | — |
| 6,000 PSI | 742 | — | — | 783 | — | 1650 |
| 5,000 PSI | — | 242 | — | — | 484 | — |
| 1800° F. | | | | | | |
| 5,000 PSI | — | — | 714 | — | — | 501 |
| 4,000 PSI | 718 | — | — | 2184 | 331 | — |
| 3,000 PSI | — | 922 | — | — | — | — |
| 1900° F. | | | | | | |
| 4,000 PSI | — | — | 273 | — | — | — |
| 3,000 PSI | 384 | — | — | 1506 | — | 1071 |
| 2,500 PSI | — | 273 | — | — | 690 | — |
| 2000° F. | | | | | | |
| 3,000 PSI | — | — | — | — | — | — |
| 2,500 PSI | — | — | — | 482 | — | 347 |
| 2,000 PSI | 275 | 103 | 769 | — | 217 | — |

These data were then employed in calculations based upon the Larson-Miller parameter to estimate the probable 10,000-hour rupture stresses that would be expected for each of these alloys at several elevated temperatures. The estimated rupture stresses at 1600° F., 1800° F., and 2000° F. are set forth in Table III below. Estimated rupture stresses of numerous prior art heat resistant alloys at these same temperatures are also set forth in Table III. These stresses are taken from the usual values represented in the metallurgical literature or, in a few instances from experimental data as presented in the literature.

TABLE III

| | CHEMICAL COMPOSITION MAJOR CONSTITUENTS BY WEIGHT PERCENT* | | | | | | ESTIMATED 10,000-HOUR RUPTURE STRESS AT VARIOUS TEMPERATURES, P.S.I. | | |
|---|---|---|---|---|---|---|---|---|---|
| ALLOY | C | Ni | Fe | Cr | W | Co | 1600° F. | 1800° F. | 2000° F. |
| 10.3 W | .06 | 37 | 23 | 28.1 | 10.3 | — | 6,000 | 2,500 | 650 |
| 12 W | .02 | 39 | 22 | 25.5 | 11.9 | — | 4,300 | 2,000 | 550 |
| 13.1 W | .07 | 37 | 20 | 27.9 | 13.1 | — | 7,600 | 3,200 | 1,100 |
| 13.6 W | .05 | 37 | 19 | 28.2 | 13.6 | — | 6,000 | 3,200 | 1,100 |
| 14.6 W | .05 | 34 | 19 | 29.4 | 14.6 | — | 4,800 | 2,300 | 700 |
| 15.1 W | .06 | 39 | 17 | 27.5 | 15.1 | — | 6,700 | 3,200 | 1,100 |
| 113 MA | .03 | 58 | — | 23 | 18 | — | 7,500 | 2,700 | 700 |
| KSN | .02 | 57 | — | 16 | 26 | — | 6,100 | 2,200 | 550 |
| MORE 2 | .20 | 50 | — | 33 | 16 | — | 6,600 | 3,000 | 1,100 |
| HA188 | .10 | 22 | 2 | 22 | 14 | 39 | 6,000 | 2,200 | 650 |
| L-605 | .10 | 10 | — | 20 | 15 | 53 | 6,800 | 2,200 | 500 |
| HK40 | .40 | 20 | 53 | 25 | — | — | 3,800 | 1,700 | 720 |
| HP45 | .45 | 35 | 38 | 25 | — | — | 3,900 | 2,250 | 900 |
| 22H | .45 | 48 | 17 | 28 | 5 | — | 5,500 | 2,400 | 850 |
| SUPER 22H | .45 | 48 | 14 | 28 | 5 | 3 | 6,600 | 2,900 | 1,200 |
| HP50WZ | .50 | 35 | 32 | 26 | 5 | — | 6,000 | 2,500 | 850 |
| SUPER-THERM | .45 | 35 | 17 | 26 | 5 | 15 | 7,400 | 3,800 | 1,300 |
| 330 | .10 | 35 | 44 | 19 | — | — | 2,400 | 1,000 | 330 |
| 800 | .07 | 32 | 47 | 21 | — | — | 2,500 | 1,000 | 250 |
| 600 | .08 | 76 | 8 | 16 | — | — | 2,500 | 1,100 | 370 |
| 800H | .08 | 32 | 46 | 21 | — | — | 3,100 | 1,200 | 400 |
| 601 | .05 | 61 | 14 | 23 | — | — | 3,000 | 1,200 | 350 |

*Almost all of these alloys contain small amounts of Mn and Si employed as deoxidizers; many contain small amounts of one or more other elements.

The first group of alloys in Table III contains the experimental alloys of the invention. Alloys 10.3 W and 12 W had room temperature elongations of 45% and 48% as cast and 13% and 8% as aged respectively. They would be readily weldable after high temperature service exposure. Thus their hot strengths should be compared to the last five alloys listed in Table III. The alloys of this last group are those commonly employed when thermal fatigue, thermal shock or weldability after periods of service are considered desirable. The inventive alloys are obviously of much higher hot strengths than the prior art alloys for which weldability is required after service exposure. It may also be seen that 10.3 W has higher hot strength than 12 W despite its lower tungsten content. This is believed to be because its titanium, carbon, silicon and chromium plus tungsten contents are all higher, resulting in greater tungsten precipitate quantities even with lower W total content. The other four inventive alloys may all be readily welded before aging at service temperatures but not after. These alloys may be compared to the second and third groups of prior art alloys set forth in Table III.

The second group of alloys in Table III contains prior art alloys of higher and lower tungsten and chromium contents than the alloys of the invention which were tested and are all either nickel base or cobalt base alloys and far costlier than the alloys of the invention. The MORE 2 alloy is said to be useful up to 2400° F., but does not provide hot strengths as high as those attainable in the inventive alloys. The other prior art alloys of the second group in Table III are all of lower chromium contents and suitable for service to 2000° F. Again, it may be seen that the inventive alloys can be formulated to provide higher hot strengths despite their high iron contents and chromium levels that render them suitable for service to 2200° F. Alloy 113 MA of this group has 1600° F. hot strength comparable to inventive alloy 13.1

W, but the latter gains steadily over the former as temperatures increase.

It may also be noted from Table III that alloys 13.1 W, 13.6 W and 15.1 W present the best hot strengths of the inventive alloys and have chromium plus tungsten contents of 41.03%, 41.50% and 42.66% respectively. Alloy 14.6 W has lower hot strengths at 44.09% combined chromium plus tungsten content. Alloys 10.3 W and 12 W have combined chromium plus tungsten contents falling below the optimum hot strength range but gain the advantage of weldability after high temperature aging in service. Alloy 14.6 W and 15.1 W. have combined chromium plus tungsten contents above the optimum hot strength range but have higher aged hardness levels. Thus, where hot abrasion is involved, it may be desirable in some applications to sacrifice optimum hot strengths for increased hot wear resistance.

Five of the six alloys of the third group in Table III are typical of prior art alloys commonly used in these applications. They all contain relatively high carbon levels and have very poor to no weldability as cast. The Supertherm alloy has hot strength above the alloys of the invention but has not been suitable for the application discussed here due to its high cost and lack of weldability.

From the above it may be seen that alloys of the invention can be selected and formulated to perform better than the three comparative groups of alloys of the prior art. They may be formulated to give better hot strengths than the far costlier nickel base or cobalt base alloys. They may be formulated to provide much higher as-cast ductility and weldability than prior art cast high hot strength alloys. And they may be formulated to provide much higher hot strengths along with excellent weldability both before and after service exposure than prior art alloys designed with this end in mind.

As various changes could be made in the above described alloy without departing from the spirit and scope of the invention, it is intended that all matter contained in the above description shall be interpreted as illustrative and not in a limiting sense.

What is claimed is:

1. A nickel-chromium-iron tungsten alloy having an austenitic structure containing tungsten precipitates which may be formulated to provide for good weldability before and after high temperature aging consisting essentially of:

| | |
|---|---|
| Nickel | 33–40% by weight |
| Chromium | 24–30% |
| Iron | 14–32% |
| Tungsten | 8–17% |
| Carbon | Up to 0.12% |
| Manganese | Up to 1% |
| Silicon | Up to 1.2% |
| Chromium plus tungsten | 34–44%. |

2. An alloy of claim 1 further including:

| | |
|---|---|
| Titanium | Up to 0.8% |
| Aluminum | Up to 0.8% |
| Zirconium | Up to 0.15% |
| Boron | Up to 0.01% |
| Cobalt | Up to 0.8% |

3. An alloy of claim 2 consisting essentially of:

| | |
|---|---|
| Nickel | 35–40% by weight |
| Chromium | 24–29% |
| Iron | 14–25% |
| Tungsten | 8.5–17% |
| Carbon | Up to 0.10% |
| Manganese | 0.3–0.8% |
| Silicon | 0.3–0.6% |
| Titanium | Up to 0.7% |
| Aluminum | Up to 0.3% |
| Zirconium | 0.03–0.06% |
| Boron | Up to 0.005% |
| Cobalt | Up to 0.8% |
| Chromium plus tungsten | 38.5–43% |

4. An alloy of claim 2 consisting essentially of:

| | |
|---|---|
| Nickel | 33–40% by weight |
| Chromium | 24–29% |
| Iron | 18–31% |
| Tungsten | 8–13% |
| Carbon | 0.04–0.08% |
| Manganese | 0.2–0.6% |
| Silicon | 0.1–0.6% |
| Titanium | 0.3–0.7% |
| Aluminum | Up to 0.3% |
| Zirconium | Up to 0.06% |
| Boron | Up to 0.005% |
| Cobalt | Up to 08% |
| Chromium plus tungsten | 34–38% |

5. An alloy of claim 3 which is readily weldable after high temperature aging consisting essentially of:

| | |
|---|---|
| Nickel | 37–39% by weight |
| Chromium | 25–28% |
| Iron | 22–23% |
| Tungsten | 10–12% |
| Carbon | 0.02–0.06% |

6. An alloy of claim 3 which is readily weldable before high temperature aging consisting essentially of:

| | |
|---|---|
| Nickel | 34–39% by weight |
| Chromium | 27–30% |
| Iron | 17–20% |
| Tungsten | 13–15.5% |
| Carbon | 0.05–0.07% |

7. An alloy of claim 3 having exceptional hot strength consisting essentially of:

| | |
|---|---|
| Nickel | 37–39% by weight |
| Chromium | 27.5–28.5% |
| Iron | 17–20% |
| Tungsten | 13–15.5% |
| Carbon | 0.05–0.07% |

8. An alloy of claim 1 having good hot abrasion resistance consisting essentially of:

| | |
|---|---|
| Nickel | 34–39% by weight |
| Chromium | 27.5–30% |
| Iron | 17–19% |
| Tungsten | 14.5–15.2% |
| Carbon | 0.05–0.06% |

9. An alloy of claim 1 consisting essentially of:

| | |
|---|---|
| Nickel | 36.65 |
| Chromium | 28.12 |
| Iron | 22.60 |
| Tungsten | 10.33 |
| Cobalt | 0.11 |
| Molybdenum | 0.19 |
| Manganese | 0.76 |
| Silicon | 0.82 |
| Carbon | 0.055 |
| Titanium | 0.26 |
| Boron | 0.005 |
| Niobium | 0.05 |
| Zirconium | 0.05 |
| Chromium plus tungsten | 38.45 |

10. An alloy of claim 1 consisting essentially of:

| | |
|---|---|
| Nickel | 39.08 |
| Chromium | 25.51 |
| Iron | 22.01 |
| Tungsten | 11.92 |
| Cobalt | 0.08 |
| Molybdenum | 0.12 |
| Manganese | 0.52 |
| Silicon | 0.61 |
| Carbon | 0.023 |
| Titanium | 0.05 |
| Boron | 0.003 |
| Niobium | 0.03 |
| Zirconium | 0.04 |
| Chromium plus tungsten | 37.43 |

11. An alloy of claim 1 consisting essentially of:

| | |
|---|---|
| Nickel | 37.27 |
| Chromium | 27.92 |
| Iron | 20.05 |
| Tungsten | 13.11 |
| Cobalt | 0.22 |
| Molybdenum | 0.12 |
| Manganese | 0.41 |
| Silicon | 0.48 |
| Carbon | 0.065 |
| Titanium | 0.27 |
| Boron | 0.005 |
| Niobium | 0.04 |
| Zirconium | 0.04 |
| Chromium plus tungsten | 41.03 |

12. An alloy of claim 1 consisting essentially of:

| | |
|---|---|
| Nickel | 37.13 |
| Chromium | 28.18 |
| Iron | 18.95 |
| Tungsten | 13.62 |
| Cobalt | 0.03 |
| Molybdenum | 0.14 |
| Manganese | 0.74 |

-continued

| | |
|---|---|
| Silicon | 0.89 |
| Carbon | 0.050 |
| Titanium | 0.22 |
| Boron | Nil |
| Niobium | 0.05 |
| Zirconium | Nil |
| Chromium plus tungsten | 41.80 |

13. An alloy of claim 1 consisting essentially of:

| | |
|---|---|
| Nickel | 34.18 |
| Chromium | 29.41 |
| Iron | 19.39 |
| Tungsten | 14.63 |
| Cobalt | 0.03 |
| Molybdenum | 0.18 |
| Manganese | 0.75 |
| Silicon | 1.09 |
| Carbon | 0.044 |
| Titanium | 0.25 |
| Boron | Nil |
| Niobium | 0.05 |
| Zirconium | Nil |
| Chromium plus tungsten | 44.04 |

14. An alloy of claim 1 consisting essentially of:

| | |
|---|---|
| Nickel | 39.13 |
| Chromium | 27.54 |
| Iron | 16.76 |
| Tungsten | 15.12 |
| Cobalt | 0.16 |
| Molybdenum | 0.09 |
| Manganese | 0.33 |
| Silicon | 0.41 |
| Carbon | 0.060 |
| Titanium | 0.36 |
| Boron | .005 |
| Niobium | Nil |
| Zirconium | .03 |
| Chromium plus tungsten | 42.66 |

15. An alloy of claim 2 consisting essentially of:

| | |
|---|---|
| Nickel | 34–40% by weight |
| Chromium | 25–30% |
| Iron | 16–23% |
| Tungsten | 10–15.5% |
| Carbon | 0.2–0.6%% |
| Manganese | 0.3–0.8% |
| Silicon | 0.4–1.1% |
| Titanium | Up to 0.4% |
| Aluminum | Up to 0.3% |
| Zirconium | Up to 0.5% |
| Boron | Up to 0.005% |
| Cobalt | Up to 0.12% |
| Chromium plus tungsten | 35–43% |

* * * * *